US005784840A

United States Patent [19]

Dodson

[11] Patent Number: 5,784,840

[45] Date of Patent: Jul. 28, 1998

[54] ADJUSTABLE WINDOW CONSTRUCTION

[75] Inventor: Earl L. Dodson, Roanoke, Va.

[73] Assignee: Lineal Technologies, Inc., Roanoke, Va.

[21] Appl. No.: 771,509

[22] Filed: Dec. 23, 1996

[51] Int. Cl.[6] ..... E05F 1/00

[52] U.S. Cl. ..... 52/204.5; 52/204.1; 52/204.51; 52/656.5; 49/429; 49/430; 49/445

[58] Field of Search ..... 52/204.1, 204.5, 52/204.51, 656.5, 656.6; 49/429, 430, 445, 446, 451

[56] References Cited

U.S. PATENT DOCUMENTS

| | | | |
|---|---|---|---|
| 2,807,838 | 10/1957 | Perry | 49/429 X |
| 2,901,768 | 9/1959 | Decker et al. | 49/445 X |
| 3,078,523 | 2/1963 | Martin | 49/429 X |
| 3,105,273 | 10/1963 | Nobes | 49/446 X |
| 3,466,806 | 9/1969 | Teggelaar et al. . | |
| 4,078,336 | 3/1978 | Prosser | 49/445 |
| 4,570,382 | 2/1986 | Suess | 49/430 |
| 5,117,586 | 6/1992 | Stark | 49/445 |
| 5,267,416 | 12/1993 | Davis | 49/445 X |

*Primary Examiner*—Wynn Wood Coggins
*Assistant Examiner*—Laura A. Callo
*Attorney, Agent, or Firm*—Banner & Witcoff, Ltd.

[57] ABSTRACT

An adjustable window construction is disclosed wherein improved sash carriers prevent damage to any of the components of the window assembly when the sash is forcibly raised to its uppermost position, or when the sash is disengaged from the upwardly biased sash carriers during removal of the sash. When a sash carrier reaches its uppermost position, the novel tapered upper end of the sash carrier gradually engages and wedges within the lower end of the spring cover located above it, slowing the sash carrier and dissipating much of its kinetic energy to reduce the force of final impact of the sash carrier with the spring cover.

16 Claims, 2 Drawing Sheets

ADJUSTABLE WINDOW CONSTRUCTION

BACKGROUND OF THE INVENTION

1. Field of the Invention

This invention relates generally to vertically movable windows and, more particularly, to an improved balance structure for a vertically adjustable window that slides along the jamb liners of a window casing in which the balance mechanism is concealed.

2. Description of the Prior Art

U.S. Pat. No. 3,466,806, which issued in 1969 to Teggelaar et al., discloses a number of balance structures for double-hung, vertically movable windows. The entire disclosure of the Teggelaar patent is incorporated herein by reference. One of Teggelaar's embodiments in particular has gained fairly widespread commercial acceptance, viz., the embodiment of FIGS. 9, 10 and 11 of the Teggelaar patent. With the exception of minor differences which reflect more recent prior art variations on the same theme, this embodiment of Teggelaar is depicted in FIGS. 1–4 of this application.

Referring to FIG. 1, a portion of a double-hung window assembly is illustrated which includes a lower or inner window sash 10 and an upper or outer window sash 12. Sashes 10 and 12 are removably retained in adjacent sliding relationship between two ribbed window casings 14, one at each side of the window assembly, which define between them a window opening. The stepped, inwardly facing surfaces of casing 14 serve as vertical guides for sashes 10 and 12, and may be in the form of jamb liners 15 made of a stiff but resilient plastic material, e.g., extruded rigid PVC, having a smooth finish Jamb liners 15 are resiliently mounted on the jambs in a well-known manner so as to exert inward pressure on sashes 10 and 12. A conventional cam lock assembly (not shown) may be affixed medially of the sashes to the top rail of sash 10 and the bottom rail of sash 12.

Formed injamb liner 15 for each sash is a passage or channel 16 in which a balance spring 18 is suspended. Channel 16 has opposed sides 20 which are joined at the rear by a back wall 22, and have at their forward edges (adjacent the sash and window opening) opposed flanges 24, which define between them an open slot 26. For inner sash 10, slot 26 may be closed by a cover member 30, located in channel 16, formed of stiff but resilient plastic material (e.g., PVC) having opposed sides 32 lying along the opposed sides 20 of channel 16, and a stepped intermediate side 34 which engages flanges 24 and fills slot 26. Cover member 30 conceals spring 18, extending from the top of the window opening to a point just below the upper edge of sash 10 when sash 10 is in its lowest (closed) position, and may be chemically welded to jamb liner 15 by means of a suitable solvent.

Each sash 10, 12, being removably secured in the window opening, is detachably coupled to the lower end of each of its respective balance springs 18 by means of the mechanism illustrated in FIGS. 2 and 3. As described in the Teggelaar patent, this mechanism comprises a "braking unit [40] preferably integrally molded of a hard, stiffly-resilient and somewhat lubricious plastic material such as nylon or Dehrin." Because "braking unit" 40 directly supports one side of the sash, it will be referred to herein by the commonly used term "sash carrier." Sash carrier 40 is dimensioned to fit closely within channel 16 and resiliently engage back wall 22 and flanges 24. Resilience is afforded by a flexible intermediate portion 42 which is biased outwardly by a leaf spring 44. More contemporary forms of sash carrier 40 include a tension adjusting screw 46 which, when urged against leaf spring 44, effectively increases the spring rate to provide greater frictional drag of sash carrier 40 within channel 16.

The upper end of sash carrier 40 has a downwardly opening hook portion 48 to which the lower end of spring 18 is attached. Hook 48 projects from a vertically extending tab 56 having a flat, horizontal upper surface 58.

Each sash 10, 12 has a threaded pin 50 which projects laterally outwardly from each side thereof near the lower end of the sash. Sashes 10, 12 are typically of wood construction so that each pin 50 typically is screwed into the sash until the threaded portion thereof is completely embedded within the sash. The distal end of pin 50 is received within a recess or hole 52 near the lower end of sash carrier 40. Hole 52 opens into a hollowed-out cavity 54, which facilitates tilting motion of the sash during detachment and reattachment of the sash. Sash carrier 40, by virtue of the balancing force of spring 16 applied thereto and frictional engagement of the sash carrier within channel 16, thus supports the side of the window assembly.

The lower ends of cover members 30 act as stops to limit upward movement of lower sash 10 so that the portion of the lock centrally mounted atop sash 10 does not contact and mar the header of the casing. Specifically, when sash 10 is raised to its uppermost position, the upper ends of sash carriers 40 abut the lower ends of cover members 30, thereby preventing further upward movement of sash 10. However, damage to the lower ends of cover members 30 usually occurs when sash 10 is forcibly raised to its uppermost position. It has been found that the use of excessive force to raise the sash to its maximum height deforms the lower ends of the cover members inwardly and into contact with the adjacent springs. This interference causes an objectionable ratcheting noise when the sash is moved. Deformation of the upper ends of the sash carriers also can result from the use of excessive force, which can interfere with smooth operation of the sash.

Damage also can result from removal of lower sash 10 from the window casing (for cleaning, repair or the like). To remove sash 10, the jamb liner 15 on each side is flexed outwardly to permit the upper end of sash 10 to be rotated inwardly (into the room), pivoting near its bottom about pins 50. When sash 10 is almost in a horizontal plane, one side of the sash is tilted upwardly, allowing the sash carrier 40 on the elevated side to move upwardly in channel 16 as the pin 50 on that side gradually withdraws from cavity 54. When pin 50 clears hole 52, sash carrier 40 typically is suddenly released from engagement with sash 10, allowing spring 18 to thrust sash carrier 40 rapidly upwardly until its upper surface 58 collides with the lower edge of cover member 30. After a number of such collisions, damage can result to both cover member 30 and sash carrier 40, which can cause objectionable noise and/or impair the proper functioning of the window balance mechanism. It can also result in disengagement of either end of the spring, which compromises balance and causes the sash to drop.

Applicant has discovered that the aforementioned damage is caused by the design of the upper end of the sash carrier. FIG. 4 depicts the points of engagement between prior art sash carrier 40 and cover member 30. These points are restricted to a very small area comprising the outer extremities of the upper surface 58 of tab 56, and the very ends of the opposed sides 32 of cover member 30. These areas bear the full brunt of the forceful impact of the sash carrier 40 against cover member 30.

SUMMARY OF THE INVENTION

It is therefore an object of the present invention to provide a balance structure for vertically movable windows wherein vigorous upward movement of the window sash to its highest position will not cause damage to any components of the window assembly.

It is a further object of the present invention to provide a balance structure for vertically movable windows wherein removal of a window sash and resulting disengagement of the sash from the sash carrier will not cause damage to any components of the window assembly.

These and other objects of the invention are accomplished by providing a vertically adjustable window construction having a window casing defining a window opening, on each side of which is a vertical guide, a vertical slot facing the window opening and an elongate vertical passage behind and communicating with the slot. A window member is located in the window opening and has sides configured to slidably mate with and be retained between the guides. A sash carrier is slidable in each of the passages and is connected through the slot to the window member. An elongate biasing member is at least partially housed in each of the passages and is attached to the sash carrier to provide an upward biasing force to at least partially counterbalance the weight of the window member An elongate cover member in each of the passages covers at least a portion of the slot in the region above the window member, the lower end of the cover member being engageable by the sash carrier when the sash carrier reaches its uppermost position. The upper end of the sash carrier is tapered and dimensioned to progressively engage the cover member to gradually slow the sash carrier and lessen its impact with the cover member.

The invention also provides an improved counterbalance sash carrier adapted to be slidably installed within a slotted vertical passage in the side of window casing and connected to a vertically adjustable window member retained in and guided by the window casing, wherein the passage has an elongate cover member located therewithin which covers at least a portion of the slot in the region above the window member. The sash carrier has a body, a connection point on the body at which the window member can be connected, a connector near the upper end of the body adapted to receive one end of an elongate biasing member at least partially housed within the passage above the sash carrier, and at least one tapered surface at the upper end of the body dimensioned to progressively engage the lower end of the cover member to gradually slow the sash carrier and lessen its impact with the cover member when the sash carrier reaches its uppermost position.

DETAILED DESCRIPTION OF A PREFERRED EMBODIMENT

In contrast to the prior art, the improved sash carrier of the invention is designed to gradually engage the cover member and distribute the dynamic forces over a greater area, thereby preventing damage to both members.

Figure 1:
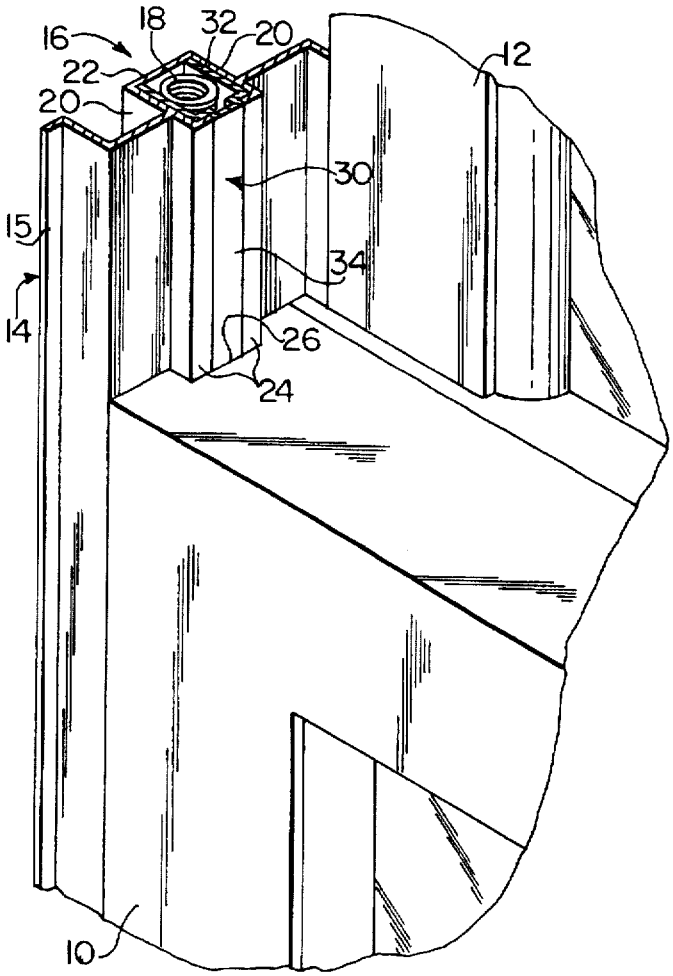
FIG. 1 PRIOR ART
FIG. 1 is a partial perspective view of a double-hung window assembly of the prior art.
Figure 2:
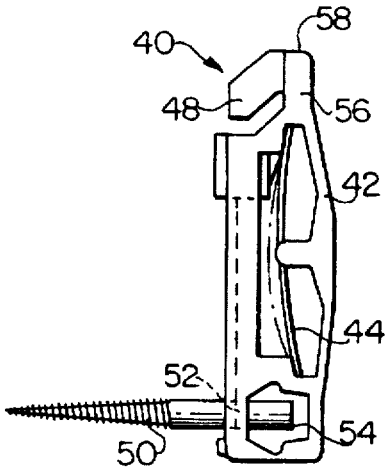
FIG. 2 PRIOR ART
FIG. 2 is a side elevational view of a sash carrier and connector assembly of the prior art.
Figure 3:
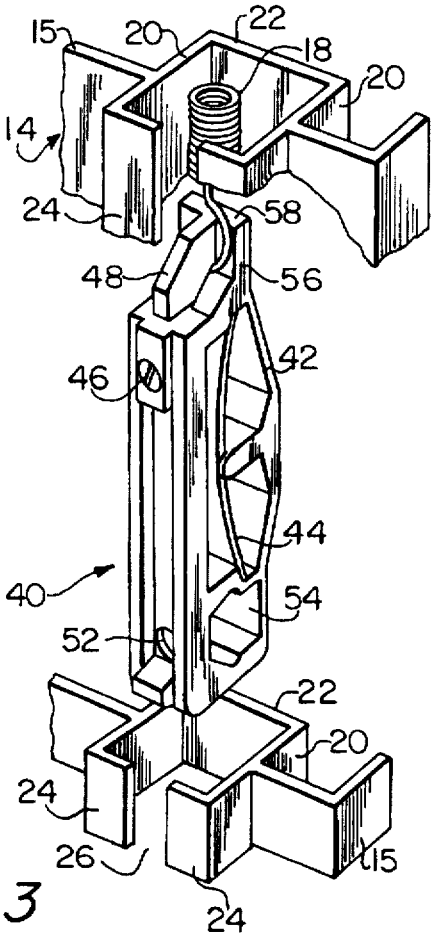
FIG. 3 PRIOR ART
FIG. 3 is a perspective view (partially broken away) of a counterbalance sash carrier assembly of the prior art showing cooperation of the sash carrier with a channel in a window casing.
Figure 4:
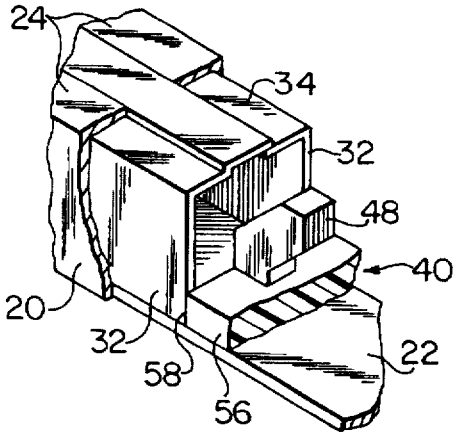
FIG. 4 PRIOR ART
FIG. 4 is a perspective view of a portion of the window casing and sash carrier of the prior art.
Figure 5:
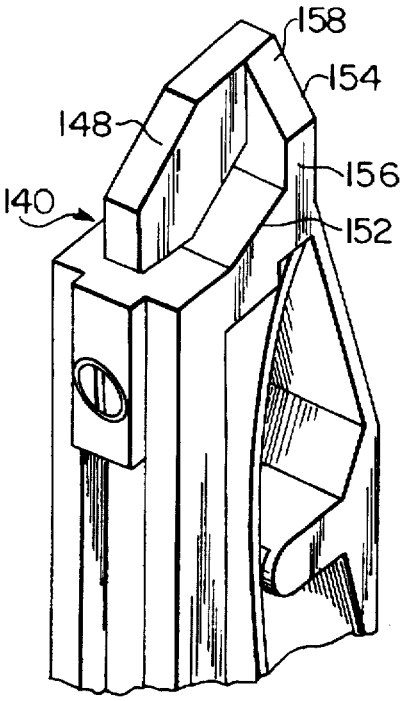
FIG. 5 is a partial perspective view of an improved sash carrier according to the invention.
Figure 6:
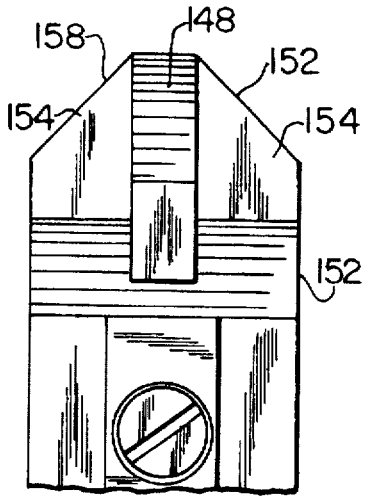
FIG. 6 is a front elevational view of the upper end of the sash carrier of FIG. 5.
Figure 7:
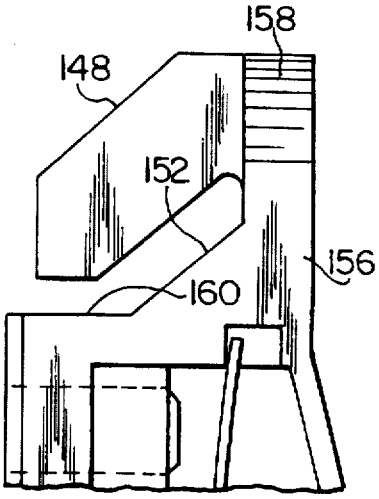
FIG. 7 is elevational view of the upper end of the sash carrier of FIGS. 5 and 6.

Referring to FIGS. 5, 6 and 7, the sash carrier according to the invention is similar in all respects to the sash carrier of the prior art (FIGS. 2, 3 and 4), except for the configuration of the upper end of the sash carrier. Thus, vertical tab 156 at the upper end of sash carrier 140 has side flanges 154 which flank hook member 148, the side flanges being tapered to provide inclined surfaces 158 which initially engage the cover member as the sash carrier moves upwardly. Further, the inclined edges 152 of sash carrier 140, which exist in the prior art sash carrier but which never were able to contact cover member 30, now are able to gradually contact the cover member by virtue of the wedging effect of the tapered upper end of sash carrier 140 and provide an added energy dissipation benefit. This is explained in detail below.

Figure 8:
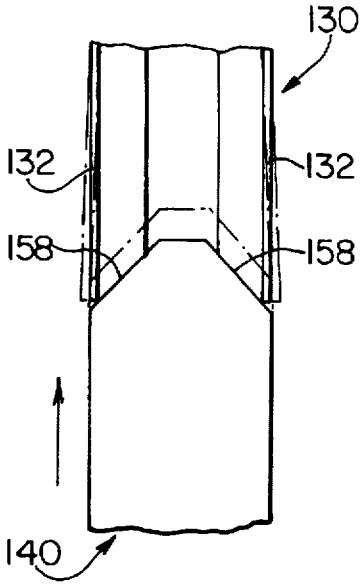
FIG. 8 is a rear elevational view of a sash carrier according to the invention illustrating its engagement with the bottom edge of a cover member installed in a window casing.

Referring to FIG. 8, upwardly moving sash carrier 140 is depicted in solid lines as just beginning to engage the lower end of cover member 130. In particular, inclined surfaces 158 engage the edges of the opposed sides 132 of cover member 130. As sash carrier 140 moves further upwardly (as illustrated by the dashed lines in FIG. 8), opposed sides 132 of cover member 130 are gradually forced to flex outwardly (as shown in dashed lines), into wedging engagement with the adjacent walls (not shown) of the channel in which the cover member is housed. This gradual wedging engagement serves to decelerate sash carrier 140 without damaging either the sash carrier or the cover member.

Figure 9:
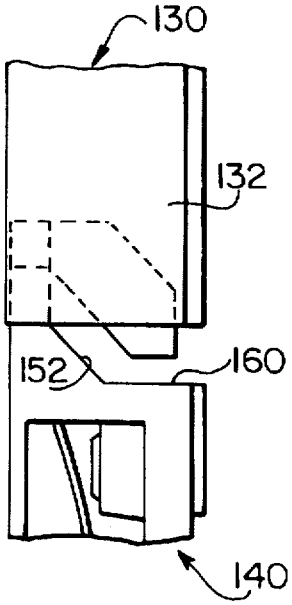
FIG. 9 is a side elevational view of the elements of FIG. 8 shown in slightly different relative positions.

As sash carrier 140 continues to move upwardly inside cover member 130, inclined edges 152 come into contact with the lower edges of the opposed sides 132 of the cover member (see FIG. 9). Because sash carrier 140 is substantially the same width as cover member 130, this engagement causes a further wedging and spreading action of sash carrier 140 on cover member 130, thereby dissipating additional kinetic energy and further slowing sash carrier 140 before its horizontal shoulder 160 comes to rest against the bottom edge of cover member 130. When that occurs, the speed and force of final impact are greatly reduced as compared to the prior art sash carrier construction, and the area of engagement between the two members is much greater than the limited area of engagement of the prior art arrangement. Thus, not only are the impact forces reduced on account of the gradual deceleration of sash carrier 140, but the final impact force as sash carrier 140 comes to rest is spread over a greater surface area. All of these factors serve to prevent any damage to sash carrier 140 or cover member 130.

The design of the improved sash carrier does not affect sash removal or installation. When the window sash is reengaged with the sash carrier 140, it takes very little effort to urge sash carrier 140 downwardly and out of wedging engagement with cover member 130 to complete the sash installation process.

It will be apparent from the foregoing that while a particular form of the invention has been illustrated and described, various modifications can be made without departing from the spirit and scope of the invention, which is to be limited only by the appended claims.

I claim:

1. A vertically adjustable window construction comprising in combination:

a window casing defining a window opening and having on each side of said opening a vertical guide, a vertical slot adjacent said guide and facing said window opening, and an elongate vertical passage behind and communicating with said slot;

a window member located in said window opening and having sides configured to slidably mate with and be retained between said guides;

a sash carrier slidable in each of said passages and connected through said slot to said window member;

an elongate biasing member at least partially housed in each of said passages and attached to said sash carrier for upwardly biasing said sash carrier to at least partially counterbalance the weight of said window member; and an elongate cover member in each of said passages located alongside said biasing member and covering at least a portion of said slot in the region above said window member, the lower end of said cover member being engageable by said sash carrier when said sash carrier reaches its uppermost position;

wherein the upper end of said sash carrier is tapered and dimensioned to progressively engage said cover member to gradually slow said sash carrier and lessen its impact with said cover member.

2. A window construction according to claim 1, wherein each of said passages is channel-shaped and each of said cover members is a channel-shaped flexible member having an intermediate side which covers said slot and opposed sides which lie along the opposed sides of said passages, the upper end of said sash carrier progressively wedging between and spreading the sides of said cover member against the sides of said passage to slow said sash carrier.

3. A window construction according to claim 2, wherein said sash carrier has an upwardly facing shoulder below the upper end thereof which engages the bottom edge of said cover member after said sash carrier has been slowed by said cover member.

4. A window construction according to claim 3 wherein said shoulder engages the bottom edges of said opposed and intermediate sides of said cover member.

5. A window construction according to claim 4 wherein the upper end of said sash carrier has chamfered corners which progressively engage and spread the opposed sides of said cover member to slow said sash carrier.

6. A window construction according to claim 5 wherein said sash carrier has inclined edges between said chamfered corners and said shoulder which progressively engage the bottom edges of the opposed sides of said cover member and further spread the opposed sides of said cover member to further slow said sash carrier after said chamfered corners enter said cover member.

7. A window construction according to claim 2 wherein the upper end of said sash carrier has chamfered corners which progressively engage and spread the opposed sides of said cover member to slow said sash carrier.

8. A window construction according to claim 7 wherein said sash carrier has inclined edges below said chamfered corners which progressively engage the bottom edges of the opposed sides of said cover member and further spread the opposed sides of said cover member to further slow said sash carrier after said chamfered corners enter said cover member.

9. An improved counterbalance sash carrier adapted to be slidably installed within a slotted vertical passage in the side of a window casing and connected to a vertically adjustable window member retained in and guided by said window casing, said passage having an elongate cover member located therewithin which covers at least a portion of the slot in the region above the window member, said sash carrier comprising:

a body;

a connection point on said body at which the window member can be connected thereto;

a connector near the upper end of said body adapted to receive one end of an elongate biasing member at least partially housed within said passage above said sash carrier; and at least one tapered surface at the upper end of said body dimensioned to progressively engage the lower end of the cover member to gradually slow said sash carrier and lessen its impact with the cover member when said sash carrier reaches its uppermost position.

10. A counterbalance sash carrier according to claim 9, further comprising an upwardly facing shoulder below the upper end thereof which is adapted to engage the bottom edge of said cover member after said sash carrier has been slowed by said cover member.

11. A counterbalance sash carrier according to claim 10, wherein the upper end of said sash carrier has chamfered corners which are adapted to progressively engage the cover member to slow said sash carrier.

12. A counterbalance sash carrier according to claim 11, wherein said sash carrier has inclined edges between said chamfered corners and said shoulder which are adapted to progressively engage the cover member to further slow said sash carrier after said chamfered corners have passed the bottom edge of said cover member.

13. An improved counterbalance sash carrier adapted to be slidably installed within a slotted vertical channel in the side of a window casing, connected to a spring housed within the channel, and detachably connected to the side of a vertically adjustable window member removably retained in and guided by said window casing, said channel having opposed sides interconnected by a back wall, and inwardly turned flanges adjacent the window member which define the slot, and having therewithin an elongate, flexible, channel-shaped cover member, the opposed sides of the cover member lying along the opposed sides of the channel and the intermediate side of the cover member covering at least a portion of the slot in the region above the window member to conceal the spring, said sash carrier comprising:

a body sized to slide within and substantially fill the cross-section of the channel and having a resilient portion which is adapted to force the front and rear surfaces of said body into frictional engagement with the back wall and the inwardly turned flanges of the channel;

a recess near the lower end of said body adapted to detachably receive a connecting member projecting from the side of the window member;

a downwardly opening hook medially located near the upper end of said body adapted to receive the lower end of the spring located in the channel above said sash carrier; and laterally projecting flanges at the upper end of said body on opposite sides of said hook, said flanges having downwardly and outwardly inclined upper surfaces adapted to progressively engage and spread the opposed sides of the cover member to gradually slow said sash carrier and lessen its impact with the cover member when said sash reaches its uppermost position.

14. A counterbalance sash carrier according to claim 13, further comprising inclined edges at the sides of said body and below said flanges which are adapted to progressively engage the bottom edges of the opposed sides of the cover member and further spread the opposed sides of the cover member to further slow said sash carrier after said flanges enter the cover member.

15. A counterbalance sash carrier according to claim 14, further comprising an upwardly facing shoulder on said body adjacent the lower ends of said inclined edges, said shoulder adapted to engage the bottom edge of the cover member to positively arrest said sash carrier after it has been slowed by engagement of said flanges and said inclined edges with the cover member.

16. A counterbalance sash carrier according to claim 15, wherein said shoulder is adapter to engage the bottom edges of the opposed and intermediate sides of the cover member.

* * * * *